United States Patent [19]

Perez et al.

[11] 4,333,438

[45] Jun. 8, 1982

[54] DEVICE FOR RECYCLING EXHAUST GASES FOR A DIESEL ENGINE

[75] Inventors: Jean Perez, Rueil; Jean-Claude Carnus, Paris, both of France

[73] Assignees: Automobiles Peugeot; Societe Anonyme Automobiles Citroen, both of Paris, France

[21] Appl. No.: 16,949

[22] Filed: Mar. 5, 1979

[30] Foreign Application Priority Data

Mar. 22, 1978 [FR] France ..... 78 08335
Dec. 5, 1978 [FR] France ..... 78 34233

[51] Int. Cl.[3] ..... F02M 25/06
[52] U.S. Cl. ..... 123/569; 123/571
[58] Field of Search ..... 123/568, 569, 571, 376, 123/399, 401

[56] References Cited

U.S. PATENT DOCUMENTS

| | | | |
|---|---|---|---|
| 3,807,376 | 4/1974 | Glockler et al. | 123/571 |
| 3,915,134 | 10/1975 | Young et al. | 123/569 X |
| 4,040,402 | 8/1977 | Nohira et al. | 123/571 |
| 4,094,287 | 6/1978 | Nohira | 123/571 |
| 4,117,904 | 10/1978 | Matsubara | 123/376 X |
| 4,147,143 | 4/1979 | Harada | 123/571 |
| 4,157,081 | 6/1979 | Wake et al. | 123/569 |

*Primary Examiner*—Stuart S. Levy
*Attorney, Agent, or Firm*—Burns, Doane, Swecker & Mathis

[57] ABSTRACT

The device comprises an induction pipe and an exhaust pipe interconnected by a connecting pipe. A closure member controlled in accordance with the conditions of operation of the engine is inserted in the connecting pipe. The connecting pipe is connected to the induction pipe downstream of a throttle valve member which is capable of assuming two throttling positions in the induction pipe in accordance with the position of the accelerator pedal of the engine.

22 Claims, 7 Drawing Figures

DEVICE FOR RECYCLING EXHAUST GASES FOR A DIESEL ENGINE

The present invention relates to a device for varying the proportion of exhaust gases recycled in a Diesel engine in accordance with the conditions of utilization of the latter.

It is known that in order to reduce the proportion of the harmful constituents in exhaust gases of a Diesel engine, in particular nitrogen oxides, it is possible to return to the induction a certain percentage of these exhaust gases.

It is also known that the recycling can bring about disturbances in the operation of the engine when the latter runs at low speed, in particular at idling speed, and that the recycling is to be avoided under full load so as to avoid the risk of emitting smoke and to benefit from the maximum power of the engine. This is why devices have already been proposed for eliminating the recycling when the engine runs at idling speed or when it is used under high load.

Lastly, it is known that it is desirable to have a greater recycling for very low loads than for the medium loads.

Now, the known devices for satisfying these various requirements are not without drawbacks.

For example, devices are known which ensure a continuous variation in the quantity or recycled gases. These devices are usually complicated and are liable to become out of order.

Devices are also known in which at least one regulating flap is actuated directly by the accelerator pedal. These devices have the drawback of increasing the force to be applied on the pedal.

Devices are also known which are designed to interrupt the recycling when the accelerator pedal is completely or almost completely released. These devices do not permit an elimination of the recycling for certain ranges of operation at low speed and medium load which is liable to disturb the operation of the engine.

An object of the device is to provide a device which satisfies the various following criteria :

Complete elimination of the recycling of the gases for low speeds of the engine and for high loads.

In the ranges where there is a recycling, establishment of two recycling levels as a function of the position of the accelerator pedal.

Use of simple means excluding devices providing a continuous variation which are usually complicated and are liable to become out of order, so as to employ only regulating devices having two positions.

ABSENCE OF REACTION ON THE ACCELERATOR PEDAL

The invention is applicable to a Diesel engine comprising an induction pipe and an exhaust pipe interconnected by a connecting pipe provided with a closure member which is controlled as a function of the conditions of utilization of the engine, said connecting pipe leading to the induction pipe downstream of a throttle member.

According to the invention, said throttle member can assume two throttling positions in said induction pipe as a function of the position of the accelerator pedal of the engine.

According to another feature, the closure member is of the on-off type which is maintained open when the speed of the engine is higher than a given level and when the travel (or angle) of depression of the accelerator pedal is less than a given value.

According to another feature of the invention, the closure member is connected to an actuating device formed by a device for causing the closure device to occupy two different opening positions.

The detector of the engine speed is formed in the known manner by a magnetic sensor associated with a rotating member of the engine, such as the starter flywheel.

The detection of the position of the accelerator pedal is ensured by magnetic sensors or electric switches which cooperate with a member connected to the accelerator lever of the injection pump of the engine, which lever is connected to the accelerator pedal.

An embodiment of the invention is described inthe ensuing description with reference to the accompanying drawings in which.

Figure 1:
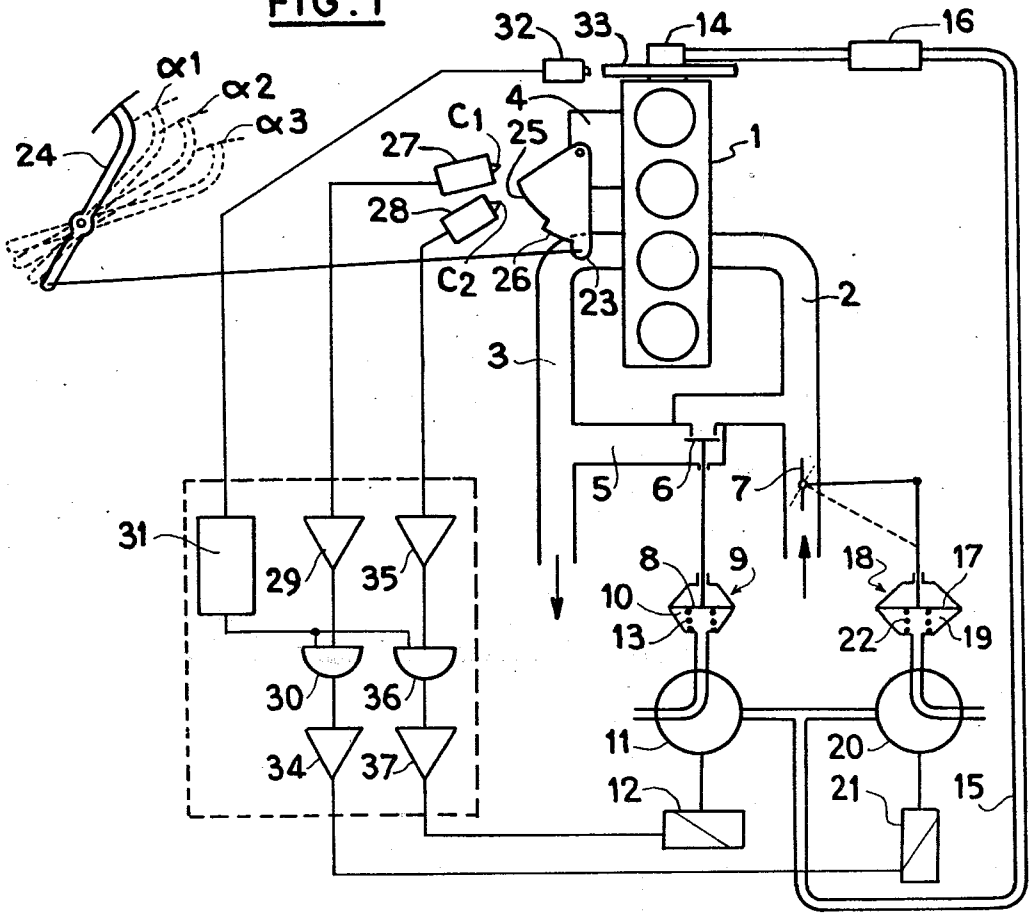
FIG. 1 is a diagrammatic view of an engine equipped in accordance with the invention.

FIG. 1 shows a Diesel engine 1 with its induction pipe 2, its exhaust pipe 3 and its injection pump 4.

The exhaust pipe 3 and induction pipe 2 are interconnected by a connecting pipe 5 in which there is inserted a closure member 6. The pipe 5 leads to the induction pipe 2 downstream of a throttle member 7.

The closure member 6 is connected to a diaphragm 8 of a vacuum box 9 whose working chamber 10 communicates with an electrically operated valve 11 having three ways actuated by an electromagnet 12. A spring 13 biases the diaphragm 8 so that in the absence of a vacuum in the chamber 10 the closure member 6 is closed. The vacuum box 9, the electrically operated valve 11 and the electromagnet 12 constitute the actuating device of the closure member 6.

When the electromagnet 12 is not excited, the valve 11 connects the chamber 10 to the atmosphere. When the electromagnet 12 is excited, the valve 11 connects the chamber 10 to a vacuum pump 14 through a piping 15 and a vacuum tank 16. The pump 14 is driven by the Diesel engine 1.

The throttle member 7 is connected to a diaphragm 17 of a vacuum box 18 whose working chamber 19 communicates with an electrically operated valve 20 which is actuated by an electromagnet 21. A spring 22 biases the diaphragm 17 so that in the absence of vacuum in the chamber 19 the throttle member 7 is wide open.

The vacuum box 18, the electrically operated valve 20 and the electromagnet 21 constitute the actuating device for the throttle member 7.

When the electromagnet 21 is not excited, the electrically operated valve 20 connects the chamber 19 to the atmosphere. When the electromagnet 21 is excited, the valve 20 connects the chamber 19 to a vacuum pump 14. In this case, the throttle member 7 is partly closed.

The injection pump 4 comprises an accelerator lever 23 connected to an accelerator pedal 24. The lever 23 is associated with two sectors 25, 26 which respectively cooperate with proximity detectors 27, 28 (the sectors 25, 26 could be separate from the accelerator lever 24 but driven at the same time as the latter).

The sectors 25, 26 and the proximity detectors 27,28 associated therewith constitute devices determining the position of the pedal 24.

The sector 25 is located in front of the detector 27 when the pedal 24 travels beyond a depression position $\alpha_1$ ; the sector 26 is located in front of the detector 28 when the pedal 24 passes beyond a depression position $\alpha_2$. The detector 27 produces a signal so long as it is not in front of the sector 25. This signal is sent to a shaper-amplifier 29, then to a first input of an AND gate 30 whose second input is connected to the output of a frequency/voltage converter 31. The input of the latter is connected to a magnetic sensor 32 placed in the plane and in the vicinity of a toothed ring 33 which is driven by the engine 1. This ring is preferably the starter flywheel of the engine.

The converter 31 sends a signal to the gate 30 when the rotational speed of the engine exceeds a certain threshhold $N_o$ of, for example, 1,500 rpm.

The output signal of the gate 30 is sent to a power amplifier 34 and from there to the electromagnet 21.

The shaper-amplifier 29, the AND gate 30 and the power amplifier 34 constitute the excitation means of the electromagnet 21.

The detector 28 produces a signal so long as it is not facing the sector 26. This signal is sent to a shaper amplifier 35 and then to a first input of an AND gate 36 whose second input is connected to the output of the converter 31. The output signal of the gate 36 is sent to a power amplifier 37 and, from there, to the electromagnet 12.

The shaper amplifier 35, the AND gate 36 and the power amplifier 37 constitute the excitation means of the electromagnet 12.

Figure 2:
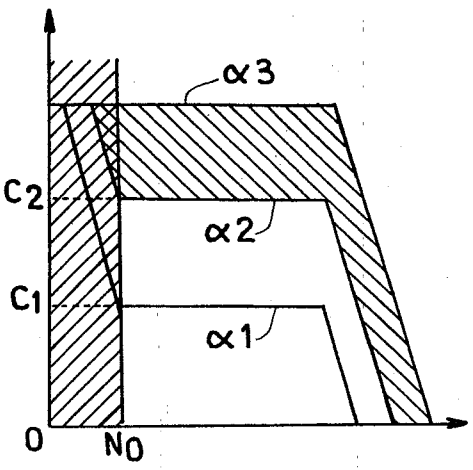
FIG. 2 is a diagram showing the value of the load as a function of the speed of the engine for different positions of the accelerator pedal.

The diagram shown in FIG. 2 shows the curves representing the load of the engine as a function of its speed for the positions $\alpha_1$ and $\alpha_2$ of the accelerator pedal 34 and for a position $\alpha_3$ corresponding, for the usual operating speeds of the engine, to full load. For these same speeds, the positions $\alpha_1$ and $\alpha_2$ respectively correspond to values $C_1$ and $C_2$ of the load which may represent, for example, $\frac{1}{4}$ and $\frac{3}{4}$ of full load.

The device just described with reference to FIG. 1 operates in the following manner :

The electromagnet 12 is excited when both the detector 28 and the converter 31 produce a signal, that is to say when the depression of the pedal 24 does not exceed the position $\alpha_2$ and the speed of the engine 1 is higher than $N_o$.

For these conditions of operation, which correspond to the non-cross-hatched zone of the diagram of FIG. 2, the closure member 6 is open and the gases are recycled.

For the other conditions, there is no recycling either because the speed of the engine is too low (the converter 31 does not produce a signal), or because the pedal is excessively depressed and therefore the load is too high (the detector 28 does not produce a signal).

The electromagnet 21 is excited when both the detector 27 and the converter 31 produce a signal, that is to say when the depression of the pedal 24 does not go beyond the position $\alpha_1$ and the speed of the engine is higher than $N_o$. For these conditions of operation, which correspond to low loads, the throttle member 7 is partly closed, Consequently, there is a certain negative pressure on the downstream side which increases the flow of gas through the pipe 5.

In a modification of the invention, the proximity detectors 27 and 28 may be replaced by electric switches.

The recycling device which will now be described with reference to FIGS. 3 to 7 is of the same type as that which has just be described. However, in order to approach optimum conditions of operation, the number of recycling levels is increased in this device while maintaining the on-off control devices.

Figure 3:
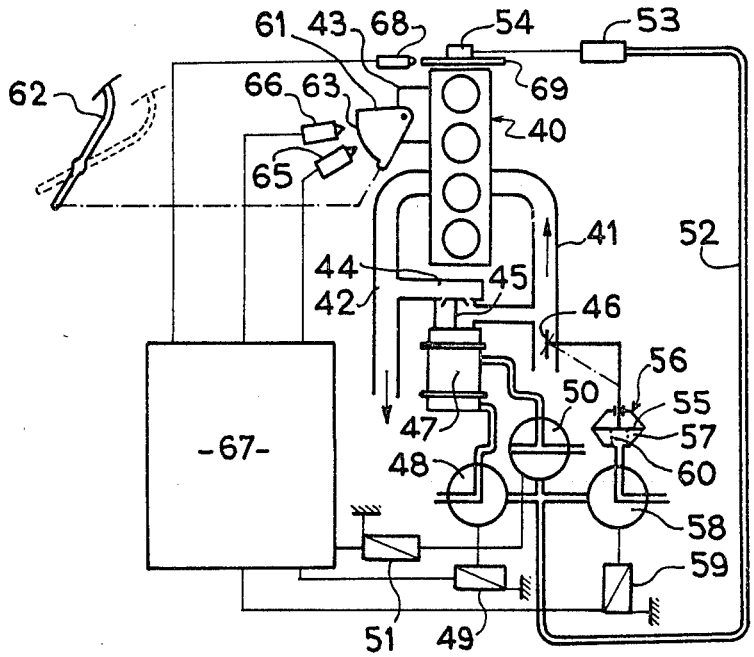
FIG. 3 is a diagrammatic view of an engine equipped in accordance with a modification of the invention.

FIG. 3 shows a Diesel engine 40 with its induction pipe 41, its exhaust pipe 42 and its injection pump 43. The exhaust pipe 42 and the induction pipe 41 are interconnected by a connecting pipe 44 in which there is inserted a closure member 45. The pipe 44 leads to the induction pipe 41 downstream of a throttle valve member 46.

The closure member 45 is controlled by a double valve 47 which will be described in detail with reference to FIG. 5.

The double valve is controlled, on one hand, by a three-way electrically operated valve 48 which is actuated by an electromagnet 49 and, on the other hand, by a three-way electrically operated valve 50 actuated by an electromagnet 51. One of the ways of each of the valves 48 and 50 communicates, by way of piping 52 and a vacuum tank 53, with a vacuum pump 54 which is driven by the Diesel engine 40. The throttle valve member 46 is connected to a diaphragm 55 of a vacuum box 56 whose working chamber 57 communicates with an electrically operated valve 58 actuated by an electromagnet 59. A spring 60 biases the diaphragm 55 so that, in the absence of a vacuum in the chamber 57, the throttle valve member 46 is wide open.

The vacuum box 56, the electrically operated valve 58 and the electromagnet 59 constitute the actuating device for the throttle valve member 46.

When the electromagnet 59 is not excited, the valve 58 connects the chamber 57 to the atmosphere. When the electromagnet 59 is excited, the valve 58 connects the chamber 57 to the vacuum pump 54. In this case, the throttle valve member 46 is partly closed.

The injection pump 43 comprises an accelerator lever 61 connected to an accelerator pedal 62. The lever 61 is associated with a sector 63 having projecting portions **64*a* and recessed portions 64*b* (see FIG. 7) which cooperate with proximity detectors 65, 66**.

The sector 63 and the proximity detectors 65, 66 associated therewith constitute devices for determining the position of the pedal 62.

The outputs of the proximity detectors 65, 66 are connected to corresponding inputs of an electronic control circuit 67 which will be described with reference to FIG. 4. The circuit 67 comprises in addition an additional input connected to the output of a magnetic sensor 68 placed in the plane and in the vicinity of a toothed ring 69 driven by the engine 40. The control circuit 67 comprises three outputs each connected to electromagnets 49, 51, 59 controlling electrically operated valves 48, 50, 58 respectively.

Figure 4:
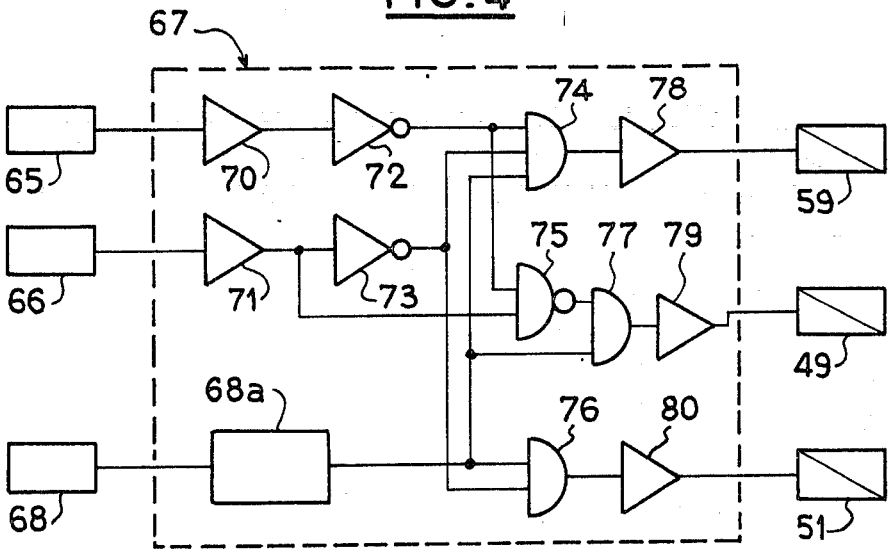
FIG. 4 shows the electronic control circuit of the device according to the invention.

FIG. 4 shows the control circuit 67 as being defined by a rectangle in dotted lines whose inputs and outputs are respectively connected to the detectors 65, 66, 68 and to the electromagnets 59, 49, 51. The control circuit 67 comprises two shaper amplifiers 70, 71 whose inputs are respectively connected to the outputs of the detectors 65, 66 whose outputs are connected through inverters 72, 73 respectively to a first input and a second input of a first AND gate 74 having three inputs.

The output of the inverter 72 is moreover connected to a first input of a NAND gate having two inputs 75, whereas the output of the inverter 73 is furthermore connected to an input of a second AND gate 76 having two inputs. The output of the shaper amplifier 71 is moreover directly connected to the second input of the NAND gate 75. The output of the NAND gate 75 is connected to a first input of an AND gate 77 having two inputs.

The output of the magnetic sensor 68 is connected to a frequency/voltage converter **78*a* which is connected to the second input of the second AND gate 76, to the second input of the AND gate 77 and to the third input of the first AND gate 74. The outputs of the gates 74, 77 and 76 are respectively connected to the electromagnets 59, 49, 51 through power amplifiers 78, 79, 80**.

Figure 5:
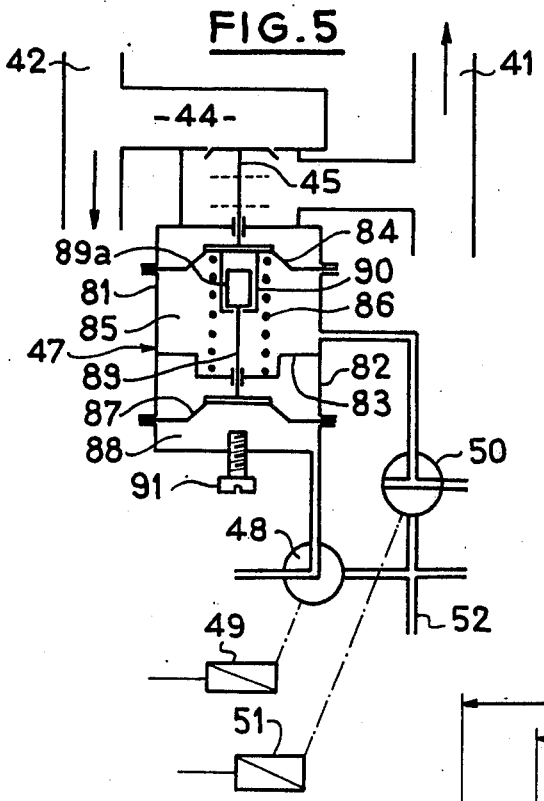
FIG. 5 is a detail of a double control valve of the closure member of the connecting pipe.
Figure 7:
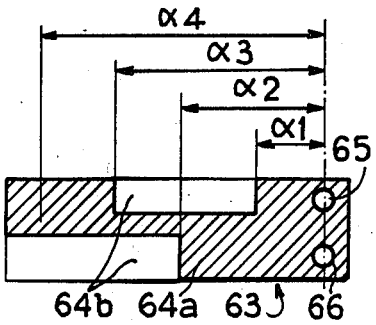
FIG. 7 is a diagrammatic detail of a device for detecting the position of the accelerator pedal.

The double control valve of the closure member 45 is shown in detail in FIG. 5.

This valve comprises a body divided into two compartments 81 and 82 by a rigid partition wall 83. Mounted in the compartment 81 is a diaphragm 84 which is connected to the closure member 45, said diaphragm defining a working chamber 85 which communicates with the electrically operated valve 50 which is actuated by the electromagnet 51. A spring 86 biases the diaphragm 84 in the direction for tending to close the closure member 45. Mounted in the compartment 82 is a second diaphragm 87 which defines a working chamber 88 which communicates with the valve 48 actuated by the electromagnet 49. The diaphragm 87 carries a rod 89 which extends in an unsealed manner through the partition wall 83 and has an end opposed to the diaphragm 87 which has an enlargement **89*a* which is free to move between two ends of a member 90 rigid with the diaphragm 84 contained in the first compartment 81**.

Disposed in the wall of the compartment 82 opposed to the partition wall 83 is a screw 91 for regulating the displacements of the diphragm 87.

Figure 6:
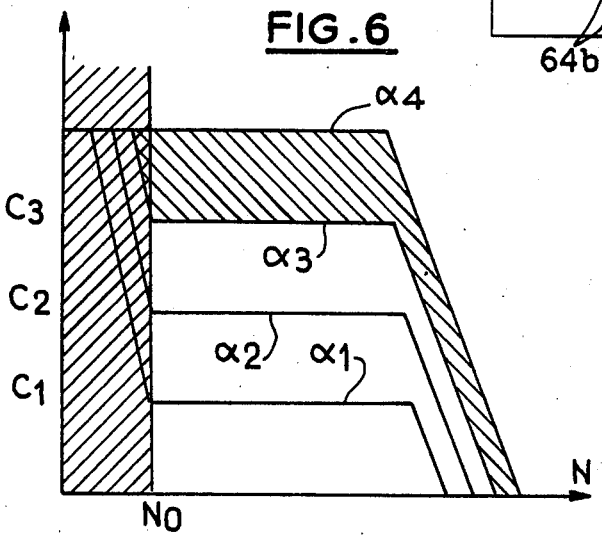
FIG. 6 is a diagram showing the value of the load as a function of the speed of the engine, for different positions of the accelerator pedal of the engine shown in FIG. 3.

The diagram shown in FIG. 6 gives the curves representing the load of the engine as a function of its speed for the positions $\alpha_1$ to $\alpha_3$ of the accelerator pedal 62 and a for a position $\alpha_4$ corresponding to full load of the engine.

For these speeds, the positions $\alpha_1$ to $\alpha_3$ respectively correspond to the values $C_1$ to $C_3$ of the load.

The device just described operates in the following manner :

As the rotational speed of the engine 40 has not reached the value $N_o$, the magnetic sensor 68 does not produce a signal at its output so that the output of the converter **68*a* is in the O state. This state is applied to an input of each of the gates 74, 77 and 76. The gates 74 and 76 being AND gates, their output is then in the logic state 0 irrespective of the states of their other inputs so that the electromagnets 59 and 51** are not excited.

As concerns the gate 77, it also produces a logic signal 0 so that the electromagnet 49 is not excited either.

Consequently, for a rotational speed lower than $N_o$, the throttle valve member 46 remains in the position thereof shown in full lines in FIG. 3, whereas the closure member 45 is closed. Consequently, the exhaust gases are not recycled.

When the rotational speed of the engine 40 becomes higher than $N_o$, a signal appears at the output of the converter 77, so that a logic signal 1 is applied to each of the inputs of the gates 74, 77,76 connected to this converter.

Assuming now that the pedal 62 is depressed at an angle $\alpha_1$ which corresponds to the production of a logic signal 0 by the detectors 65 and 66, there appear at the inputs of the gate 74 three logic signals 1, which cause a logic signal 1 to appear at its output and this signal is amplified by the amplifier 78 and ensures the excitation of the electromagnet 59 and consequently the putting of the valve 58 in communication with the vacuum pump 54.

Thus, the throttle valve member 46 is placed in its position shown in dot-dash line in FIG. 3 amnd it partly closes the section of the induction pipe 41. There is produced a certain negative pressure on the downstream side which, for a given position of opening of the closure member 45, produces an increase in the flow through the pipe 44.

A 1 and an 0 appear at the inputs of the gate 75 which are connected to the detectors 65 and 66. This NAND gate therefore delivers a logic signal 1 on an input of the AND gate 77 whereas a 1 is also present on its input connected to the converter **68*a***.

The AND gate 77 therefore delivers also a logic signal 1, which ensures, after its amplification by the amplifier 79, the excitation of the electromagnet 49 actuating the valve 48. The latter is also put in communication with the vacuum pump 54 which produces a negative pressure in the chamber 88 of the double control valve of the closure member 55 (FIG. 5).

The gate 76 receives two logic signals 1 at its inputs so that it produces the excitation of the electromagnet 51 which puts the valve 50 in communication with the vacuum pump 54 which produces a negative pressure in the chamber 85 of the aforementioned double valve and the downward displacement of the diaphragm 84. As the partition wall 83 is not sealed, the negative pressure also acts on the side of the diaphragm 87 opposed to the chamber 88 so that the diaphragm 87 is practically in equilibrium and the enlargment **89*a* of the rod 89 does not oppose a maximum displacement of the diaphragm 84. The closure member 45 is therefore wide open and, as moreover the throttle valve member 46** is partly closed, a maximum quantity of gas is recycled.

When the pedal 62 is depressed to an angular position between $\alpha_1$ and $\alpha_2$, the sensor 65 facing a recessed portion **64*b* of the sector 63 of the lever 61 produces a signal whereas the sensor 66 still does not produce a signal. The circuit shown in FIG. 2 produces a logic signal 0 at its output connected to the electromagnet 59 and logic signals 1 at its other two outputs. These signals maintain the opening of the closure member 45 at a maximum and produce the complete opening of the throttle valve member 46**. A level of recycling which is lower than the preceding case is thus produced.

Between the angular positions $\alpha_2$ and $\alpha_3$ of the pedal 46, the two sensors 65 and 66 are each facing a recessed portion **64*b* of the sector 63 and produce a signal. The circuit shown in FIG. 4 then produces a logic signal 1 at its output connected to the electromagnet 49** and logic signals 1 at its other two outputs.

As the electromagnet 51 is not excited, the chamber 85 is no longer subjected to the negative pressure whereas the electromagnet 49 remains excited and the chamber 88 remains subjected to the negative pressure.

The diaphragm 88 then abuts against the screw 91 and the enlargement 89*a* of the rod 89 shifts the diaphragm 84 through a distance less than its maximum travel. The closure member 45 is therefore partly open by an amount set by the screw 91, whereas the throttle valve member 46 remains wide open since the valve 59 is not excited. Thus there is obtained a level of recycling which is still lower than the preceding case.

When the pedal 62 passes beyond the angular position $\alpha_3$ the sensor 66 still produces a signal whereas the sensor 65 no longer produces a signal. No electromagnet is excited and the closure member 45 is thus completely closed and any recycling of the exhaust gases is interrupted.

The arrangement which has just been described permits, owing to the increase in the number of recycling levels, following very closely the optimum conditions producing the minimum of harmful constituents in the exhaust gases.

Having now described our invention what we claim as new and desire to secure by Letters Patent is:

1. A device for recycling exhaust gases for a Diesel engine comprising an induction pipe having a throttle member therein, an exhaust pipe, a connecting pipe interconnecting the induction pipe and the exhaust pipe, a closure member inserted in the connecting pipe, an accelerator pedal for the engine, said connecting pipe being connected to the induction pipe downstream of the throttle member relative to flow through the induction pipe, control means including closure means for activating the closure member to prevent recycling when the speed of the engine is below a first predetermined non zero value and also when the accelerator pedal passes beyond a first predetermined limit; said control means further including throttle means for switching the throttle member to pass in a step-wise fashion between two distinct positions, a relatively open position to a relatively closed position, when both the speed of the engine is above a second predetermined value and the accelerator pedal has not passed a second predetermined limit and for switching the throttle member to pass in a step-wise fashion from said relatively closed position to a relatively open position when the accelerator pedal has passed said second predetermined limit.

2. A device as claimed in claim 1, wherein the closure member is an on-off type of control means and means are provided for maintaining the closure member open when the speed of the engine is higher than a given level and when the travel or angle of depression of the accelerator pedal is less than a given value.

3. A device as claimed in claim 2, comprising an actuating device connected to the closure member and associated with said control means.

4. A device as claimed in claim 1, wherein said throttle member is connected to an actuating device associated with said control means responsive to the position of the accelerator pedal.

5. A device as claimed in claim 4, wherein said control means includes means for determining the position of the accelerator pedal, tachometer means for association with the engine and for producing an electric signal when the rotational speed of the engine reaches a predetermined value, an electromagnet connected to said control means, and means for exciting the electromagnet and connected to the means determining the position of the pedal and to the tachometer means.

6. A device as claimed in claim 4, comprising a vacuum pump adapted to be driven by the engine and wherein the actuating device of the throttle member comprises a vacuum box having a diaphragm connected to said throttle member, the vaccum box defining a working chamber, an electrically operated valve communicating with the working chamber, an electromagnet connected to said control means and connected to operate the electrically operated valve, said valve being operative to connect said working chamber selectively to the atmosphere and to the vacuum pump depending on the state of the electromagnet.

7. A device as claimed in claim 6, wherein said control means includes means for determining the position of the accelerator pedal, tachometer means for association with the engine and for producing an electric signal when the rotational speed of the engine reaches a predetermined value, and means for exciting the electromagnet and connected to the means determining the position of the pedal and to the tachometer means.

8. A device as claimed in claim 7, wherein said means determining the position of the accelerator pedal comprise an accelerator lever for connecting the accelerator pedal to the injection pump of the engine, a sector associated with the accelerator pedal, the sector cooperating with a proximity detector which is connected to an input of said means for exciting the electromagnet.

9. A device as claimed in claim 7, wherein said tachometer means comprise a toothed wheel adapted to be driven by the engine, a magnetic sensor placed in the vicinity of the toothed wheel and a frequency-voltage converter connected to said means exciting the electromagnet and to the magnetic sensor.

10. A device as claimed in claim 7, wherein said means exciting the electromagnet of the device actuating the throttle member comprise a shaper-amplifier, an AND gate having a first input connected through the shaper-amplifier to an output of the device determining the position of the accelerator pedal and a second input connected to an output of said tachometer means, the AND gate having an output connected to the electromagnet through a power amplifier.

11. A device as claimed in claim 1, comprising an actuating device connected to the closure member and associated with said control means responsive to the position of the accelerator pedal.

12. A device as claimed in claim 11, wherein said control means includes means for determining the position of the accelerator pedal, tachometer means for association with the engine and for producing an electric signal when the speed of rotation of the engine reaches a predetermined value, an electromagnet connected to said control means and means for exciting the electromagnet and connected to the means determining the position of the pedal and to the tachometer means.

13. A device as claimed in claim 12, wherein said means determining the position of the accelerator pedal comprise an accelerator lever for connecting the accelerator pedal to the injection pump of the engine, at least one sector associated with the accelerator pedal, and cooperating with a proximity detector which is connected to an input of said means for exciting the electromagnet.

14. A device as claimed in claims 8 or 13, wherein two sectors are part of a common accelerator lever and are angularly offset so as to cooperate in succession with the associated proximity detectors in the course of the displacement of the accelerator pedal.

15. A device as claimed in claim 11, comprising a vacuum pump adapted to be driven by the engine and wherein the actuating device of the closure member comprises a vacuum box having a diaphragm which is connected to the closure member and defines a working chamber, an electrically operated valve communicating with the working chamber, an electromagnet connected to said control means and connected to operate the electrically operative valve, said valve being operative to connect the working chamber selectively to the atmosphere and to the vacuum pump as a function of the state of the electromagnet.

16. A device as claimed in claim 15, wherein said control means includes means for determining the position of the accelerator pedal, tachometer means for association with the engine and for producing an electric signal when the speed of rotation of the engine reaches a predetermined value, and means for exciting the electromagnet and connected to the means determining the position of the pedal and to the tachometer means.

17. A device as claimed in claim 12, wherein said tachometer means comprise a toothed wheel adapted to be driven by the engine, a magnetic sensor placed in the vicinity of the toothed wheel and a frequency-voltage converter connected to said means exciting the electromagnet and to the magnetic sensor.

18. A device as claimed in claim 12, wherein said means exciting the electromagnet of the device actuating the closure member comprise a shaper-amplifier, an AND gate having a first input connected through the shaper-amplifier to an output of the device determining the position of the accelerator pedal, and a second input connected to an output of said tachometer means, the AND gate having an output connected to the electromagnet through a power amplifier.

19. A device as claimed in claim 1, comprising an actuating device for the closure member and associated with to be controlled by the control means, the actuating device being capable of putting the closure member in two different opening positions.

20. The device according to claim 1, wherein the said first and second predetermined values for the engine speed are the same.

21. The device according to claim 20, wherein the said first predetermined limit for the accelerator pedal is greater than the said second predetermined limit.

22. The device according to claim 21, wherein the control means includes means for partially closing said closure means to partially prevent recycling when the accelerator pedal has passed said second predetermined limit but has not yet passed said first predetermined limit.

* * * * *